US006120566A

United States Patent [19]

Mifune et al.

[11] Patent Number: 6,120,566

[45] Date of Patent: Sep. 19, 2000

[54] LIQUID FUEL FOR COMBUSTION APPLIANCES AND COMBUSTION APPLIANCE USING THE SAME

[75] Inventors: Hideo Mifune; Yasuaki Nakamura; Takashi Tsukamoto, all of Shizuoka-ken, Japan

[73] Assignee: Tokai Corporation, Shizuoka-ken, Japan

[21] Appl. No.: 09/068,433

[22] PCT Filed: Sep. 5, 1997

[86] PCT No.: PCT/JP97/03119

§ 371 Date: Jul. 23, 1998

§ 102(e) Date: Jul. 23, 1998

[87] PCT Pub. No.: WO98/11176

PCT Pub. Date: Mar. 19, 1998

[30] Foreign Application Priority Data

| | | | |
|---|---|---|---|
| Sep. 11, 1996 | [JP] | Japan | 8-240333 |
| Oct. 2, 1996 | [JP] | Japan | 8-261634 |

[51] Int. Cl.[7] ..... C10L 1/00; F23D 3/24

[52] U.S. Cl. ..... 44/451; 44/519; 431/320

[58] Field of Search ..... 44/451, 519; 431/320

[56] References Cited

U.S. PATENT DOCUMENTS

| | | | |
|---|---|---|---|
| 2,774,235 | 12/1956 | Ruetz | 431/320 |
| 4,242,100 | 12/1980 | Parker et al. | 44/451 |
| 4,279,619 | 7/1981 | Tsuzuki et al. | 44/438 |
| 4,405,336 | 9/1983 | Badger | 44/438 |
| 4,536,188 | 8/1985 | DeWitt et al. | 44/318 |
| 4,569,656 | 2/1986 | Shimizu et al. | 431/325 |
| 4,624,633 | 11/1986 | Bandel | 431/320 |
| 4,801,305 | 1/1989 | Muller et al. | 44/451 |
| 5,147,413 | 9/1992 | Kiovsky et al. | 44/328 |
| 5,266,080 | 11/1993 | Kiovsky et al. | 44/312 |
| 5,417,725 | 5/1995 | Graves | 44/388 |

FOREIGN PATENT DOCUMENTS

| | | |
|---|---|---|
| 2339355 | 5/1990 | France . |
| 59-155480 | 9/1984 | Japan . |
| 61-222981 | 10/1986 | Japan . |
| 147657 | 12/1990 | Japan . |
| 117493 | 4/1991 | Japan . |
| 65488 | 3/1992 | Japan . |

OTHER PUBLICATIONS

European Patent Office Search report dated Mar. 3, 2000.

*Primary Examiner*—Ellen M. McAvoy
*Attorney, Agent, or Firm*—BakerBotts, LLP

[57] ABSTRACT

A liquid fuel for combustion appliances, in which a combustion wick for sucking up the fuel by the utilization of capillarity is used, contains an alcohol as a principal constituent and contains a hydrocarbon compound, which has approximately the same boiling point as that of the principal constituent, as a flame reaction agent. By the addition of the flame reaction agent, which is not accompanied by the occurrence of clogging of the combustion wick, the combustion flame of an alcohol, which otherwise produces a colorless flame, is colored and its visual perceptibility is thereby enhanced, such that the structure of the combustion appliance may be kept simple and the flame stability may be obtained reliably.

6 Claims, 10 Drawing Sheets

LIQUID FUEL FOR COMBUSTION APPLIANCES AND COMBUSTION APPLIANCE USING THE SAME

TECHNICAL FIELD

This invention relates to a liquid fuel for combustion appliances, such as lighters provided with a combustion wick. This invention also relates to a combustion appliance using the liquid fuel.

This invention particularly relates to a composition of the liquid fuel for use in combustion appliances, such as lighters for smoker's requisites and other types of lighters, which liquid fuel produces a combustion flame having a high visual perceptibility and eliminates the problems in that, in cases where alcohols are employed as the fuels, a colorless combustion flame is produced and cannot easily be perceived visually.

BACKGROUND ART

Ordinarily, as fuels in combustion appliances, such as lighters for smoker's requisites, other types of lighters, torches, and illumination devices, alcohol fuels, such as ethyl alcohol, petroleum benzine types of benzine fuels, or liquefied gas fuels, such as butane gas or propane gas, have heretofore been utilized.

The performances, the levels of convenience of handling, and the design structures of the combustion appliances vary in accordance with the kinds of the fuels used, and the fuels have their own features.

For example, in cases where the benzine fuels, which are mixtures of petroleum benzine types of hydrocarbon compounds, are used, since such a fuel is the mixture of the compounds having different boiling points, the problems described below occur. Specifically, a benzine constituent having a low boiling point volatilizes at the initial stage of use, at which the combustion appliance is lighted, and the constituent which volatilizes successively shifts to hydrocarbons having high boiling points. Therefore, the composition of the fuel, which remains in the combustion appliance, changes with the passage of the combustion time, and a change in flame length occurs. The same problems are also encountered with gasoline. Also, since benzine has a high volatility, the combustion appliance using benzine must have an enclosed structure for reducing the volatilization of benzine from a fuel storage region and the portion of a combustion wick. If the enclosure is insufficient, the fuel will be lost due to volatilization, and the operation for replenishing the fuel must be carried out very frequently. Further, benzine and gasoline have specific odors, which some persons dislike.

The liquefied gas fuels have a high gas pressure at temperatures falling within the range, in which the combustion appliance is used, and therefore the vessel for storing the fuels must have a pressure-resistant structure. Also, the flame length varies in accordance with variations in gas pressure. In particular, the liquefied gas fuels have the characteristics such that their gas pressures markedly vary logarithmically with respect to temperatures, and therefore the problems occur in that the flame length changes markedly, depending upon temperatures. In order for the change in flame length to be reduced, a special design countermeasure for carrying out temperature compensation for a fuel feeding mechanism of the combustion appliance must be taken. Therefore, the structure cannot be kept simple, and the cost cannot be kept low.

As for the alcohol fuels, lower monohydric alcohols, such as ethyl alcohol, methyl alcohol, and propyl alcohol, are liquids at normal temperatures and have comparatively low vapor pressures. Therefore, the enclosure with respect to the fuel storing region and the combustion wick may be carried out with a comparatively simple enclosed structure such that the alcohols may not volatilize. Accordingly, the structure of the combustion appliance can be kept simple, and the cost can be kept comparatively low. However, the alcohol fuels have the problems in that their combustion flames are colorless and cannot easily be perceived visually, and therefore the lighting and burning state cannot be confirmed easily at a light site.

Various techniques for coloring the flames produced by the alcohol fuels described above have heretofore been proposed. In a first technique, a flame reaction coloring agent is blown into the combustion flame, and the combustion flame is colored with the flame reaction. However, it is difficult for the first technique to be employed for small combustion appliances, such as lighters.

In a second technique, a flame reaction coloring agent is dissolved in the alcohol fuels. As such a flame reaction coloring agent, a metal salt, which is capable of undergoing a flame reaction and soluble in alcohols, is used. Examples of the flame reaction agents using the metal salts include cupric oxide, strontium chloride, potassium carbonate, lithium nitrate, lithium chloride, boric acid esters, lithium bromide, and cesium carbonate. (Such agents are disclosed in, for example, Japanese Unexamined Patent Publication Nos. 59(1984)-155480 and 61(1986)-222981, Japanese Unexamined Utility Model Publication Nos. 1(1989)-101071and2(1990)-147657, and Japanese Unexamined Patent Publication Nos. 4(1992)-117493 and4(1992)-65488.)

However, with the combustion appliances using the liquid fuels, which contain the aforesaid metal salts added as the flame reaction agents to alcohols, the problems described below occur. Specifically, in the structure, in which the liquid fuel is sucked up with the capillarity through the combustion wick and is lighted at the end portion of the combustion wick, as the combustion of the liquid fuel proceeds, the flame reaction agent is successively sucked up together with the alcohol fuel and is deposited on the surface of the combustion wick. As a result, the combustion wick is clogged with the deposited metal salt. Due to the clogging of the combustion wick, the suction of the fuel through the combustion wick is obstructed, the flame length becomes short, and a lighting failure occurs ultimately.

In the present invention, research has been carried out to obtain a flame reaction agent, which is free from the occurrence of the clogging of the combustion wick due to the addition of the flame reaction agent described above. The present invention eliminates the problems with regard to the colorless flame produced by the combustion of alcohols, and enhances the convenience of the use of alcohol types of liquid fuels.

Specifically, in view of the advantages of a combustion appliance using an alcohol fuel containing an alcohol, such as a lower monohydric alcohol, as the principal constituent, in that the structure can be kept simple without the necessity of the consideration of the volatility of benzine in a combustion appliance using petroleum benzine types of mixed hydrocarbon compounds and the consideration of a high-pressure gas in a combustion appliance using a liquefied gas fuel, the object of the present invention is to provide a liquid fuel for combustion appliances, which has good characteristics, such as stabilization of the flame length of a combustion flame, which enables the combustion flame to be colored efficiently by the selection of a flame reaction agent that does not adversely affect the good characteristics, and which thereby enables the lighting and burning state to be easily perceived visually. Another object of the present invention is to provide a combustion appliance, such as a lighter for smoker's requisites, in which the liquid fuel is used.

Also, in the present invention, research has been carried out to develop a liquid fuel, which provides convenience of a level equivalent to that of the alcohol type of liquid fuel described above, and which eliminates the problems with regard to a colorless flame produced by combustion.

Specifically, a further object of the present invention is to provide a liquid fuel for combustion appliances, which has good characteristics equivalent to those of an alcohol fuel, such as stabilization of the flame length of a combustion flame, which produces a colored combustion flame, and which has no hygroscopic property. A still further object of the present invention is to provide a combustion appliance, such as a lighter for smoker's requisites, in which the liquid fuel is used.

DISCLOSURE OF INVENTION

A liquid fuel for combustion appliances in accordance with the present invention, which solves the problems described above, is characterized by containing an alcohol as a principal constituent and containing a hydrocarbon compound, which has approximately the same boiling point as that of the principal constituent, as a flame reaction agent.

The principal constituent should preferably be a lower monohydric alcohol selected from the group consisting of methyl alcohol, ethyl alcohol, and propyl alcohol, and the flame reaction agent should preferably be a saturated hydrocarbon, which has a boiling point close to the boiling point of the principal constituent.

Specifically, the principal constituent should preferably be ethyl alcohol, and the flame reaction agent should preferably be at least one kind of hydrocarbon selected from the group consisting of hexane and heptane.

The present invention also provides a combustion appliance using the fuel having the composition described above, comprising:

i) a fuel reservoir for storing a liquid fuel, the liquid fuel containing an alcohol as a principal constituent and containing a hydrocarbon compound, which has approximately the same boiling point as that of the principal constituent, as a flame reaction agent, ii) a combustion wick, which sucks up the liquid fuel from the fuel reservoir by the utilization of capillarity and enables the liquid fuel to be burned at an end portion, and iii) a lighting mechanism, which lights the combustion wick.

The aforesaid liquid fuel for combustion appliances in accordance with the present invention contains an alcohol as the principal constituent and contains a hydrocarbon compound, which has approximately the same boiling point as that of the principal constituent, as the flame reaction agent. Therefore, the hydrocarbon compound serving as the flame reaction agent burns, accompanying the combustion of the alcohol serving as the principal constituent, and the flame is colored by the high-temperature light emission of the liberated carbon. Accordingly, the combustion flame can easily be perceived visually. Also, the coloring is of a yellow-orange color, which is close to the natural flame color, and therefore no incompatible feeling is given to the user. Further, the combustion of the hydrocarbon compound is not accompanied by deposition of substances, such as metal salts. Therefore, there is no risk that the combustion wick is clogged, and a stable flame length can be obtained during a long time of use. The advantages of the alcohol type of liquid fuel, such as the simplicity of the enclosure of the combustion appliance and the stability of the combustion flame, can be obtained sufficiently.

The present invention further provides a liquid fuel for combustion appliances, which is characterized by being composed of at least one kind of compound selected from the group consisting of heptane, octane, and nonane.

The present invention still further provides a combustion appliance, comprising:

i) a fuel reservoir for storing a liquid fuel, which is composed of at least one kind of compound selected from the group consisting of heptane, octane, and nonane, ii) a combustion wick, which sucks up the liquid fuel from the fuel reservoir by the utilization of capillarity and enables the liquid fuel to be burned at an end portion, and iii) a lighting mechanism, which lights the combustion wick.

The aforesaid liquid fuel for combustion appliances in accordance with the present invention is composed of at least one kind of compound selected from the group consisting of heptane, octane, and nonane. Therefore, the combustion flame produced by the liquid fuel is colored by the high-temperature light emission of the liberated carbon. Accordingly, the combustion flame can easily be perceived visually. Also, the coloring is of a yellow-orange color, which is close to the natural flame color, and therefore no incompatible feeling is given to the user. Further, in the combustion of the hydrocarbon compound, any deposit adhering to the combustion wick does not occur. Therefore, there is no risk that the combustion wick is clogged, and a stable flame length can be obtained during a long time of use. The advantages equivalent to those of the alcohol fuel, such as the simplicity of the enclosure of the combustion appliance and the stability of the combustion flame, can be obtained sufficiently.

Heptane, octane, and nonane are the saturated hydrocarbons. The other kinds of saturated hydrocarbons are not suitable as the liquid fuel in accordance with the present invention. Specifically, in view of the use of the combustion appliance, methane, ethane, propane, butane, and pentane, which are the saturated hydrocarbons having a small number of carbon atoms, have a high vapor pressure and are in the gas state at normal temperatures. Therefore, such a compound must be liquefied under pressure and sealed in a pressure-resistant vessel, and the structure of the combustion appliance cannot be kept simple. Hexane, heptane, octane, and nonane are in the liquid state at temperatures falling within the range, in which the combustion appliance is used, and are thus easy to use. However, hexane has a high vapor pressure. In cases where hexane is used in a combustion appliance, particularly a lighter for smoker's requisites, hexane shows a large change in flame length after being lighted and is therefore not practicable. Hydrocarbons having a larger number of carbon atoms have low vapor pressures and are difficult to light with an ordinary lighting method.

BEST MODE OF CARRYING OUT THE INVENTION

Figure 1:
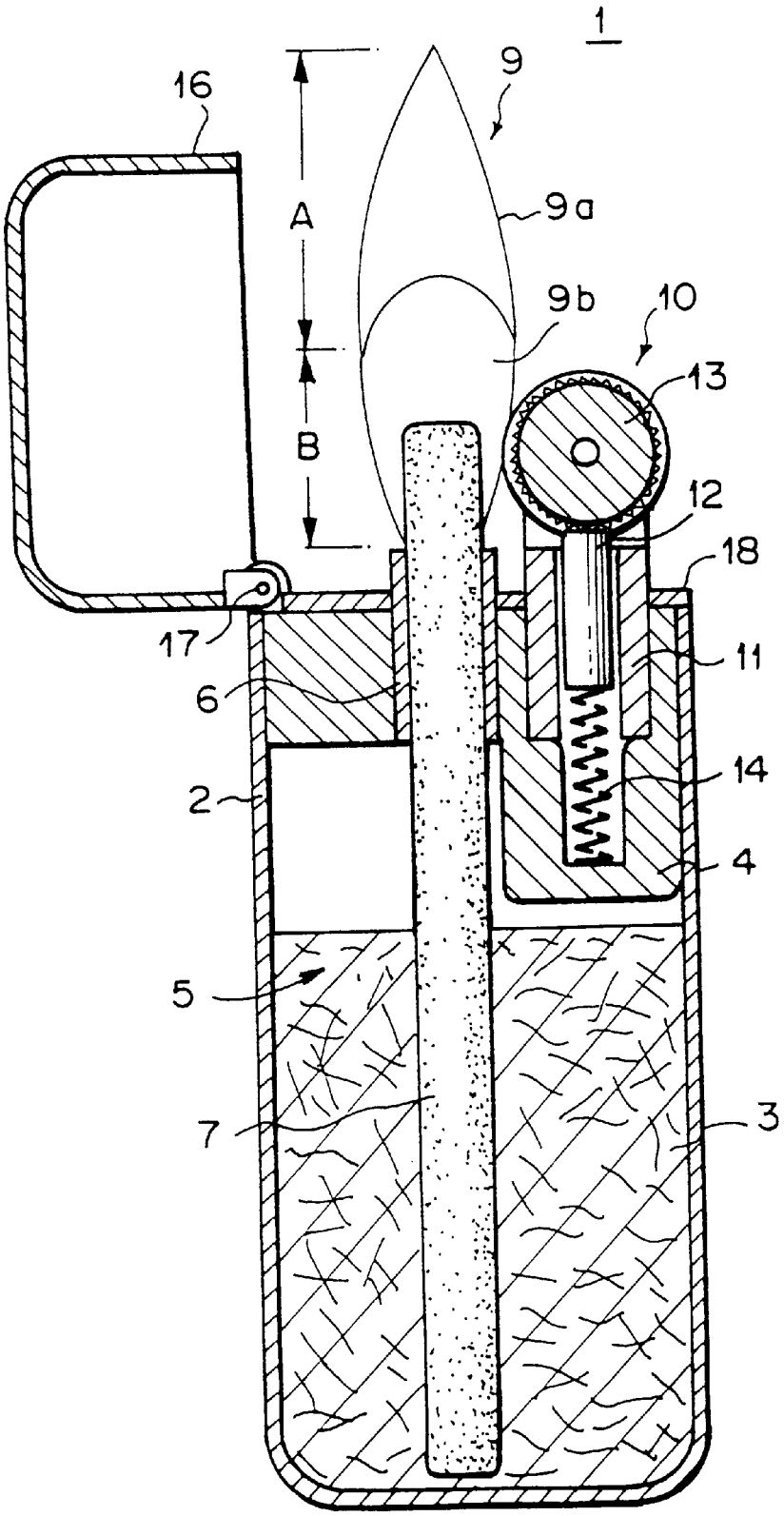
FIG. 1 is a schematic sectional view showing an embodiment of the combustion appliance for the liquid fuel in accordance with the present invention, which takes on the form of a lighter.

Embodiments of the liquid fuel and the combustion appliance in accordance with the present invention will be described hereinbelow with reference to the accompanying drawings.

Basically, a first liquid fuel in accordance with the present invention contains, as a principal constituent, an alcohol, such as a lower monohydric alcohol selected from the group consisting of methyl alcohol, ethyl alcohol, and propyl alcohol. The first liquid fuel in accordance with the present invention also contains, as a flame reaction agent, at least one kind of hydrocarbon compound, which has approximately the same boiling point as that of the principal constituent, such as a saturated hydrocarbon selected from the group consisting of hexane, heptane, octane, nonane, cyclohexadiene, and cycloheptene.

The fuel constituents described above have the melting points (m.p.) and the boiling points (b.p.) shown below.

| | | | | |
|---|---|---|---|---|
| Methyl alcohol: | m.p. | −98° C. | b.p. | 65° C. |
| Ethyl alcohol: | m.p. | −115° C. | b.p. | 78° C. |
| Propyl alcohol: | m.p. | −127° C. | b.p. | 97° C. |
| Hexane: | m.p. | −97° C. | b.p. | 69° C. |
| Heptane: | m.p. | −91° C. | b.p. | 98° C. |
| Octane: | m.p. | −57° C. | b.p. | 126° C. |
| Nonane: | m.p. | −51° C. | b.p. | 150° C. |
| Cyclohexadiene: | m.p. | −95° C. | b.p. | 81° C. |
| Cycloheptene: | m.p. | −56° C. | b.p. | 115° C. |

In cases where ethyl alcohol is employed as the alcohol, since its boiling point is 78° C. as shown above, hexane having a boiling point of 69° C. or heptane having a boiling point of 98° C. is employed as the saturated hydrocarbon, which has a boiling point close to the boiling point of ethyl alcohol and serves as the flame reaction agent. Alternatively, a mixture of hexane and heptane may be added as the flame reaction agent. In cases where the liquid fuel is injected into a lighter, which will be described later with reference to FIG. 1, and lighted, the end portion of the combustion flame becomes colored in a yellow-orange color. As the amount of the flame reaction agent added becomes large, the length of the colored portion of the flame becomes long and the ratio of the colored flame portion to the entire flame length becomes high.

When it is considered that the flame of the lighter is to be seen and a tobacco is to be lighted by the flame, the coloring of the flame can be achieved by the addition of the aforesaid flame reaction agent in a proportion of several percentage. Thus the end portion of the flame can be colored to some extent by the addition of a small amount of the flame reaction agent. Therefore, an appropriate amount of the flame reaction agent is added in accordance with a desired coloring range (the details will be described later).

Propyl alcohol and a higher alcohol have a specific odor and are therefore not appropriate. From this point of view, ethyl alcohol should preferably be employed as the liquid fuel for the lighter for smoker's requisites. In combustion appliances used for the other purposes, alcohols other than ethyl alcohol can be used. In accordance with the kind of the alcohol employed as the principal constituent, a hydrocarbon compound having a boiling point close to the boiling point of the alcohol is selected and added as the flame reaction agent, and the combustion flame is thereby colored.

The aforesaid flame reaction agent has a boiling point equivalent to that of the alcohol employed as the principal constituent. Therefore, in cases where the liquid fuel is sucked up through a combustion wick and lighted, with the passage of the combustion time, the amounts of the principal constituent and the flame reaction agent decrease approximately in their initial mixing ratio, and the ratio of the amount of the principal constituent and the amount of the flame reaction agent to each other in the residual liquid fuel does not change. Accordingly, the liquid fuel has the characteristics such that the flame length and the length of the colored flame portion may not change, no clogging may occur, and the combustion can thereby continue.

A second liquid fuel in accordance with the present invention is composed of at least one kind of compound selected from the group consisting of heptane, octane, and nonane. These compounds may be employed alone or as a mixture of two or more of them.

In cases where the second liquid fuel is injected into the lighter, which will be described later with reference to FIG. 1, a combustion flame, which is colored in a yellow-orange color due to high-temperature light emission of liberated carbon, is obtained. Therefore, the combustion flame can easily be perceived visually.

The second liquid fuel containing the constituent described above has the characteristics such that, in cases where the second liquid fuel is sucked up through a combustion wick and lighted, the liquid fuel may not exhibit hygroscopic properties, the flame length may not change, no clogging may occur, and the combustion can thereby continue. In cases where a mixed fuel, which contains two or more of compounds selected from the group consisting of heptane, octane, and nonane, is used, since the difference in boiling point between the two or more compounds is small, little effect occurs from fractional distillation due to the difference in boiling point, and little change occurs in flame length with the passage of the combustion time. Thus the problems as those of the aforesaid benzine type of mixed fuel do not occur.

FIG. 1 is a schematic sectional view showing an embodiment of the combustion appliance for the liquid fuel in accordance with the present invention, which takes on the form of a lighter. With reference to FIG. 1, a lighter 1 is provided with a bottomed case-like tank 2. A fiber material 3 (wadding) is inserted into the tank 2. An upper cover 4 is secured to the upper part of the tank 2. In this manner, a fuel reservoir 5 for storing the liquid fuel described above is formed.

By way of example, the tank 2 is constituted of a molded product of polypropylene and has an internal volume of 5 $cm^3$. As the fiber material 3, 0.5 g of polypropylene fibers having a thickness of 1 to 2 denier are pushed into the tank 2. Also, 4 cc of the liquid fuel is injected into the tank 2, the fiber material 3 is thus impregnated with the liquid fuel, and the liquid fuel is thereby stored in the tank 2. As the liquid fuel, a mixed liquid fuel, which contains 95 wt % of ethyl alcohol and 5 wt % of n-hexane, or a liquid fuel, which is composed of n-heptane alone, is employed.

A wick holder 6 is inserted vertically through a center portion of the upper cover 4 and into the tank 2. A porous combustion wick 7 is fitted into the wick holder 6. A lower end portion of the combustion wick 7 is brought into contact with the fiber material 3, which is contained in the tank 2. By the utilization of capillarity, the combustion wick 7 sucks up the liquid fuel, which is contained in the fiber material 3, to a wick end, which is projected upwardly from the wick holder 6. The thus sucked-up fuel is lighted at the projected wick end and is burned with a flame being produced.

By way of example, the combustion wick 7 is formed in a porous rod-like shape by bundling glass fibers (length: 55 mm, weight: 0.2 g) into a rod-like bundle having a diameter of 1.4 mm, covering the outer circumference of the bundle with cotton fibers, and winding a reinforcement copper wire around the bundle such that the diameter may become equal to 2.8 mm. The wick end of the combustion wick 7 is projected from the wick holder 6 by a length such that the flame length may become equal to, for example, 30 mm. In this embodiment, the length of projection of the wick end from the wick holder 6 is equal to approximately 7 mm.

Alternatively, the combustion wick 7 may be formed as a porous wick by bundling glass fibers (length: 55 mm, weight: 0.04 g) into a rod-like shape having a diameter of 3.0 mm. The wick end of the thus formed combustion wick 7 is projected from the wick holder 6 by a length such that the flame length may become equal to, for example, 30 mm. In such a case, the length of projection of the wick end from the wick holder 6 may be set to be approximately 2 mm.

A lighting mechanism 10 is located in the upper cover 4 such that the lighting mechanism 10 may stand facing the wick end of the combustion wick 7. The lighting mechanism 10 comprises a bracket 11, which is secured to the upper cover 4, and an ignition stone 12, which is inserted into the bracket 11 such that it can move vertically. The lighting mechanism 10 also comprises a rotatable file 13, which is located at the upper end of the bracket 11, and a stone pushing spring 14, which pushes the ignition stone 12 such that the end of the ignition stone 12 may be pushed against the circumferential surface of the rotatable file 13 by the urging force of the stone pushing spring 14. When the rotatable file 13 is rotated, sparks are thrown out from the ignition stone 12 toward the combustion wick 7.

An openable cap 16 covers the region above the combustion wick 7 and the lighting mechanism 10. The cap 16 is pivotably supported for rotation by a pin 17 on one end portion of the upper surface of the upper cover 4. The portion, at which the tank 2 or the upper cover 4 comes into contact with the cap 16, is provided with a sealing material 18, such that the portion may be hermetically sealed and prevents the liquid fuel from evaporating.

When the cap 16 of the lighter 1 is opened and the lighting mechanism 10 is operated in order to light the liquid fuel, a flame 9 is produced by the combustion wick 7. The upper end portion of the flame 9 is colored by the flame reaction agent, and a colored flame 9*a* is thereby formed. The lower portion of the flame is a non-colored flame 9*b*. The length A of the colored flame 9*a* and the length B of the non-colored flame 9*b* take values falling within the ranges measured in the experimental examples described below.

In the experimental examples described below, the lighter 1 described above was used, one of liquid fuels having various compositions described above was injected into the fuel reservoir 5, and the combustion was evaluated.

EXPERIMENTAL EXAMPLE 1

The experiments were carried out in order to find the relationship between the amount of a flame reaction agent added with respect to an alcohol serving as the principal constituent and the length of a colored flame. Liquid fuels, which contained ethyl alcohol as the principal constituent and various amounts of n-hexane as the flame reaction agent, were prepared. Thereafter, 4 cc of each liquid fuel was injected into the aforesaid lighter, and the length of the entire combustion flame was adjusted at 30 mm. At this time, the colored flame length A and the non-colored flame length B were measured.

Figure 2:
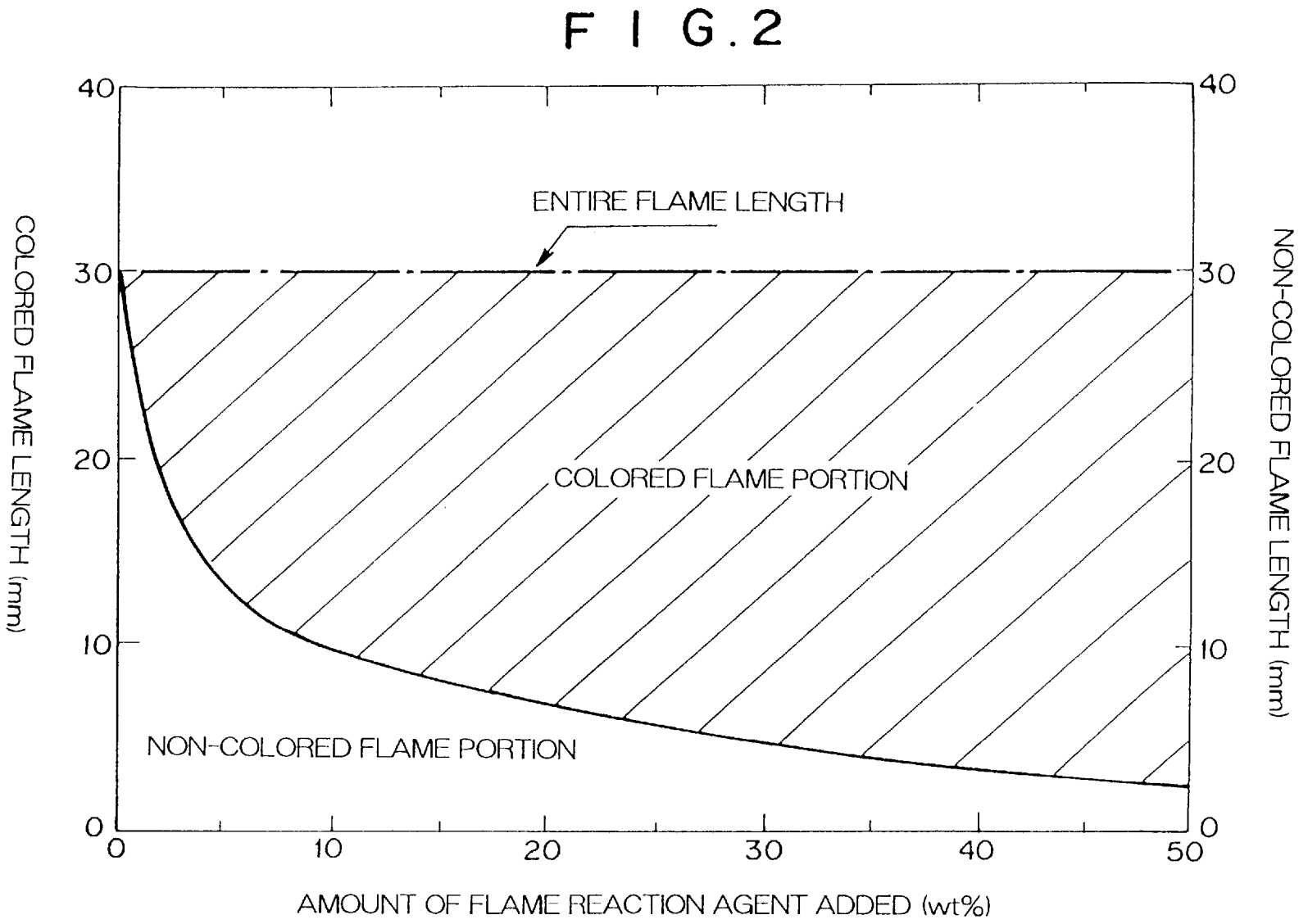
FIG. 2 is a graph showing the results of Experimental Example 1 carried out for finding the relationship between the amount of a flame reaction agent added and the length of a colored flame with a first liquid fuel in accordance with the present invention.

The results shown in FIG. 2 were obtained. As illustrated in FIG. 2, in cases where no flame reaction agent was added, the entire flame was the non-colored flame. As the amount of n-hexane added became large, the yellow-orange colored flame length became long, and the non-colored flame length became short. In the region in which the amount of the flame reaction agent added was at most 5 wt %, the colored flame length increased sharply in accordance with the increase in the amount of the flame reaction agent added. When the flame reaction agent was added in an amount of approximately 3 wt %, an approximately one-half portion of the flame was colored. With the addition of 40 to 50 wt % of the flame reaction agent, approximately the entire portion of the flame was colored.

In the cases of the actual lighter for smoker's requisites, it is sufficient that an approximately one-half portion of the entire flame be colored. Therefore, the amount of the flame reaction agent (n-hexane) should preferably be at least 2 wt %.

In cases where n-heptane was employed as the flame reaction agent and its amounts added with respect to the principal constituent (ethyl alcohol) were changed in the same manner as that described above, the same results as those with n-hexane were obtained with respect to the change in the colored flame length A.

EXPERIMENTAL EXAMPLE 2

The experiments were carried out in order to find the relationship between the number of times of lighter use and the length of a colored flame. The liquid fuel used contained 95 wt % of ethyl alcohol as the principal constituent and 5 wt % of n-hexane as the flame reaction agent. In the same manner as that in Experimental Example 1, 4 cc of the liquid fuel was injected into the lighter, and the length of the entire flame was adjusted at 30 mm. Thereafter, the liquid fuel was lighted with the lighting operation and allowed to burn for 1.5 seconds. The fire was then extinguished. The use operation was repeated, and the colored flame length was measured at intervals of a predetermined number of times of lighter use.

Figure 3:
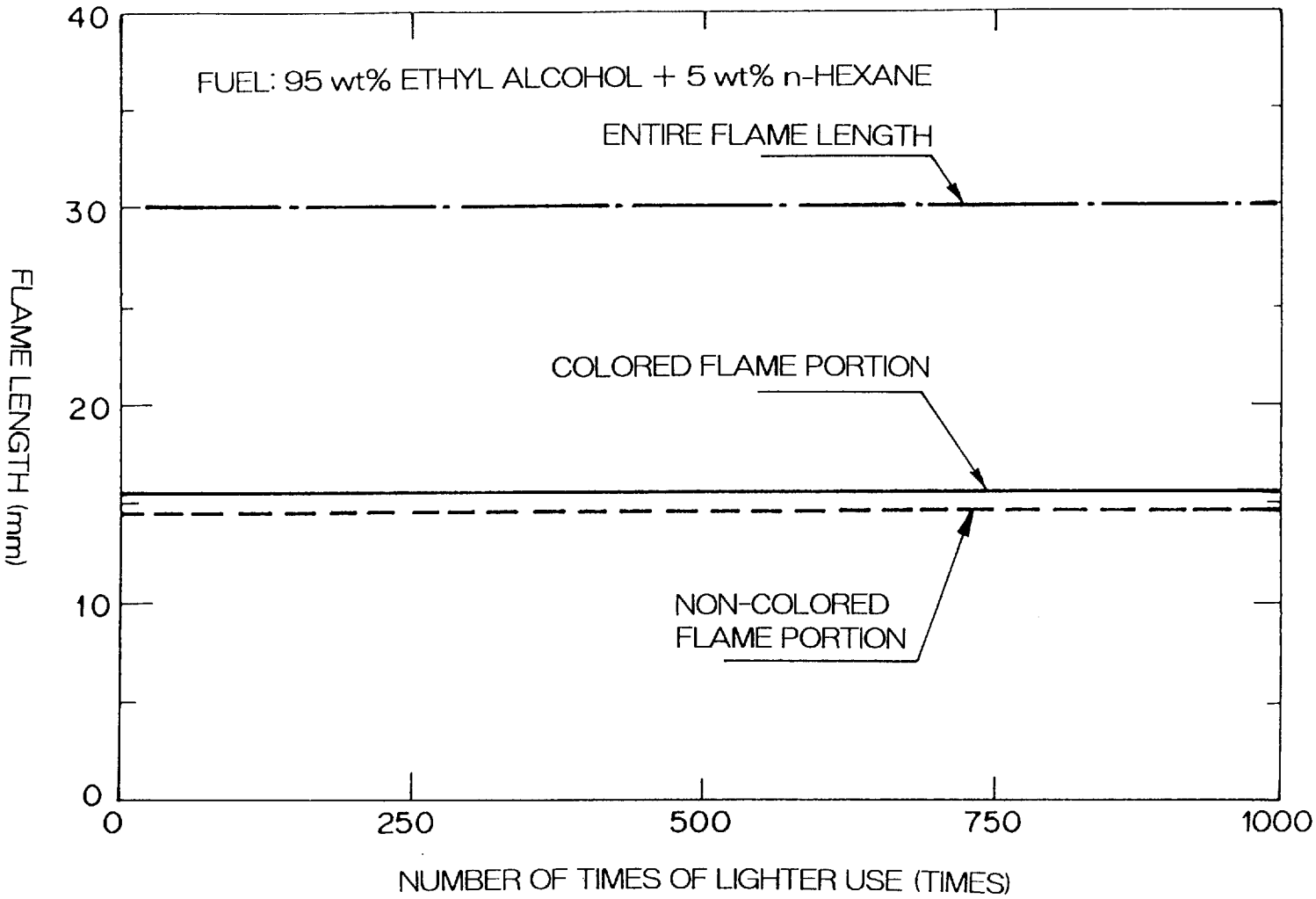
FIG. 3 is a graph showing the results of Experimental Example 2 carried out for finding the relationship between the number of times of lighter use and the length of a colored flame with the first liquid fuel in accordance with the present invention.

The results shown in FIG. 3 were obtained. As illustrated in FIG. 3, even though the number of times of lighter use became large, the colored flame length did not change. This is because, even though the amount of the residual liquid fuel changes, the ratio of the amount of the alcohol and the amount of the flame reaction agent to each other does not change.

In cases where n-heptane was employed as the flame reaction agent and a change in colored flame length with respect to the number of times of lighter use was measured, the same results as those described above were obtained, and no change in colored flame length was found.

EXPERIMENTAL EXAMPLE 3

The experiments were carried out in order to find the relationship between the number of times of lighter use and the length of an entire flame. Also, in a comparative example, experiments were carried out by using a liquid fuel containing a metal salt as the flame reaction agent. As the liquid fuels in accordance with the present invention, a liquid fuel, which contained 95 wt % of ethyl alcohol and 5 wt % of n-hexane, and a liquid fuel, which contained 95 wt % of ethyl alcohol and 5 wt % of n-heptane, were used. The liquid fuel in the comparative example was prepared by dissolving 5 wt % of lithium chloride in 95 wt % of ethyl alcohol. As for each of the liquid fuels, 4 cc of the liquid fuel was injected into the lighter, and the initial flame length was adjusted at 30 mm. Thereafter, the use operation was repeated in the same manner as that in Experimental Example 2, and the entire flame length was measured at intervals of a predetermined number of times of lighter use.

Figure 4:
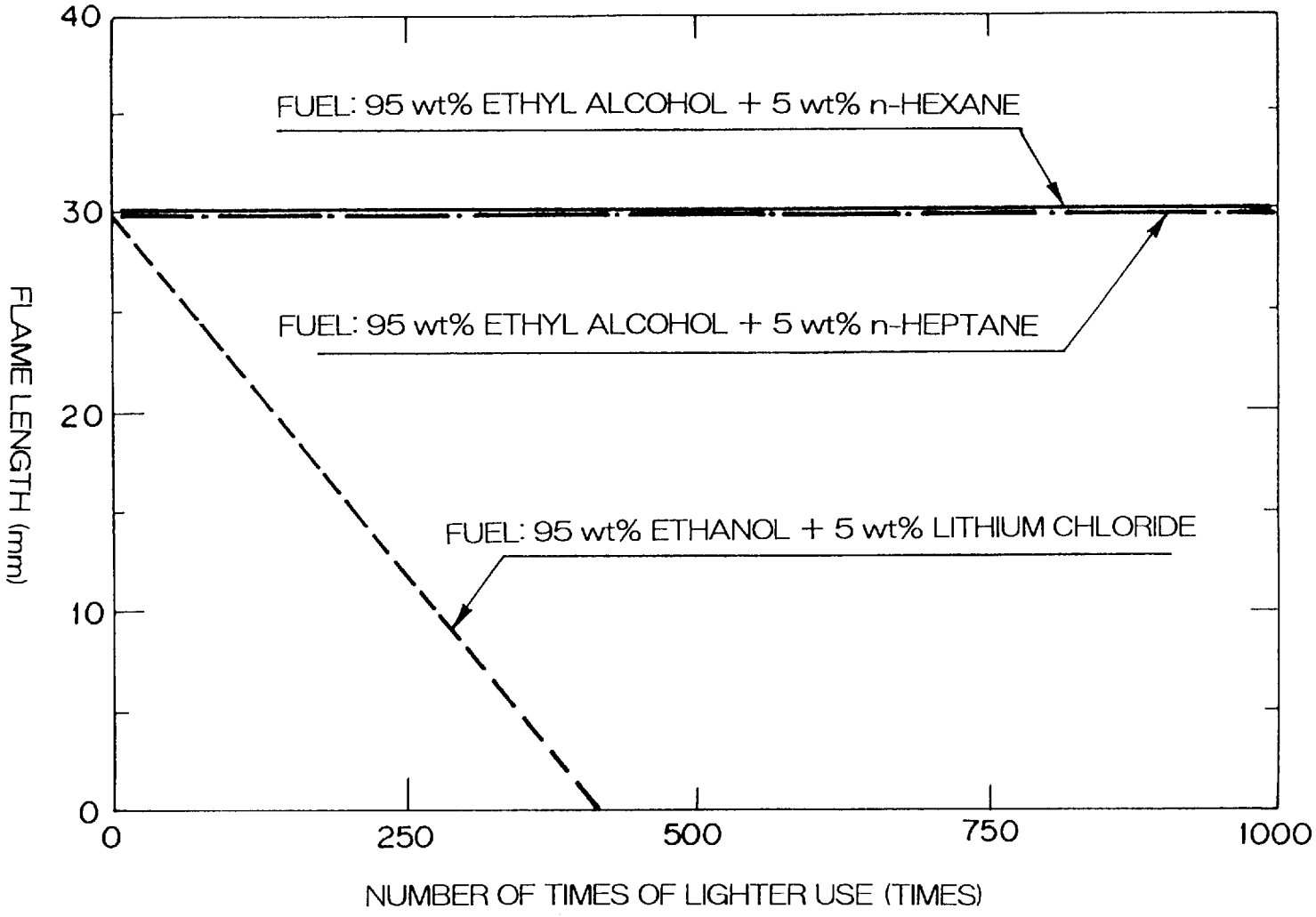
FIG. 4 is a graph showing the results of Experimental Example 3 carried out for finding the relationship between the number of times of lighter use and the length of an entire flame with the first liquid fuel in accordance with the present invention, the graph also showing the results of a comparative example.

The results shown in FIG. 4 were obtained. As illustrated in FIG. 4, in the comparative example in which the metal salt (lithium chloride) was used as the flame reaction agent, as the number of times of lighter use became large, the flame length sharply became short. This is because, when the lighter use is repeated, lithium chloride is deposited at the wick end of the combustion wick, the rate of oozing of the liquid fuel becomes small, and the flame length becomes short. As a result, when the lighter was used 300 times, even though there was the residual liquid fuel, the lighting of the wick and the combustion could not be carried out, and the lighter could not be used any more. On the other hand, in the experimental example in accordance with the present invention, in which n-hexane was used, and in the experimental example in accordance with the present invention, in which n-heptane was used, when the number of times of lighter use became large, the flame length did not change, and the predetermined flame length was kept stably.

EXPERIMENTAL EXAMPLE 4

In the experiments, a change in entire flame length with respect to a change in ambient temperature was measured. Also, in comparative examples, such a change was measured by using a liquid fuel, which was composed of petroleum benzine, or a liquefied gas lighter. As the liquid fuels in accordance with the present invention, as in Experimental Example 3, a liquid fuel, which contained 95 wt % of ethyl alcohol and 5 wt % of n-hexane, and a liquid fuel, which contained 95 wt % of ethyl alcohol and 5 wt % of n-heptane, were used. The liquid fuel in one of the comparative examples was petroleum benzine. As for each of the liquid fuels, 4 cc of the liquid fuel was injected into the lighter, and a change in flame length was measured by changing the ambient temperature to a value falling within the range of 5° C. to 40° C. Also, in the other comparative example, a commercially available liquefied gas lighter, which was filled with a liquefied gas containing i-butane as the principal fuel, was prepared, and a change in flame length was measured by changing the ambient temperature in the same manner. In every experiment, the reference flame length was adjusted such that the flame length might be 30 mm at an ambient temperature of 23° C.

Figure 5:
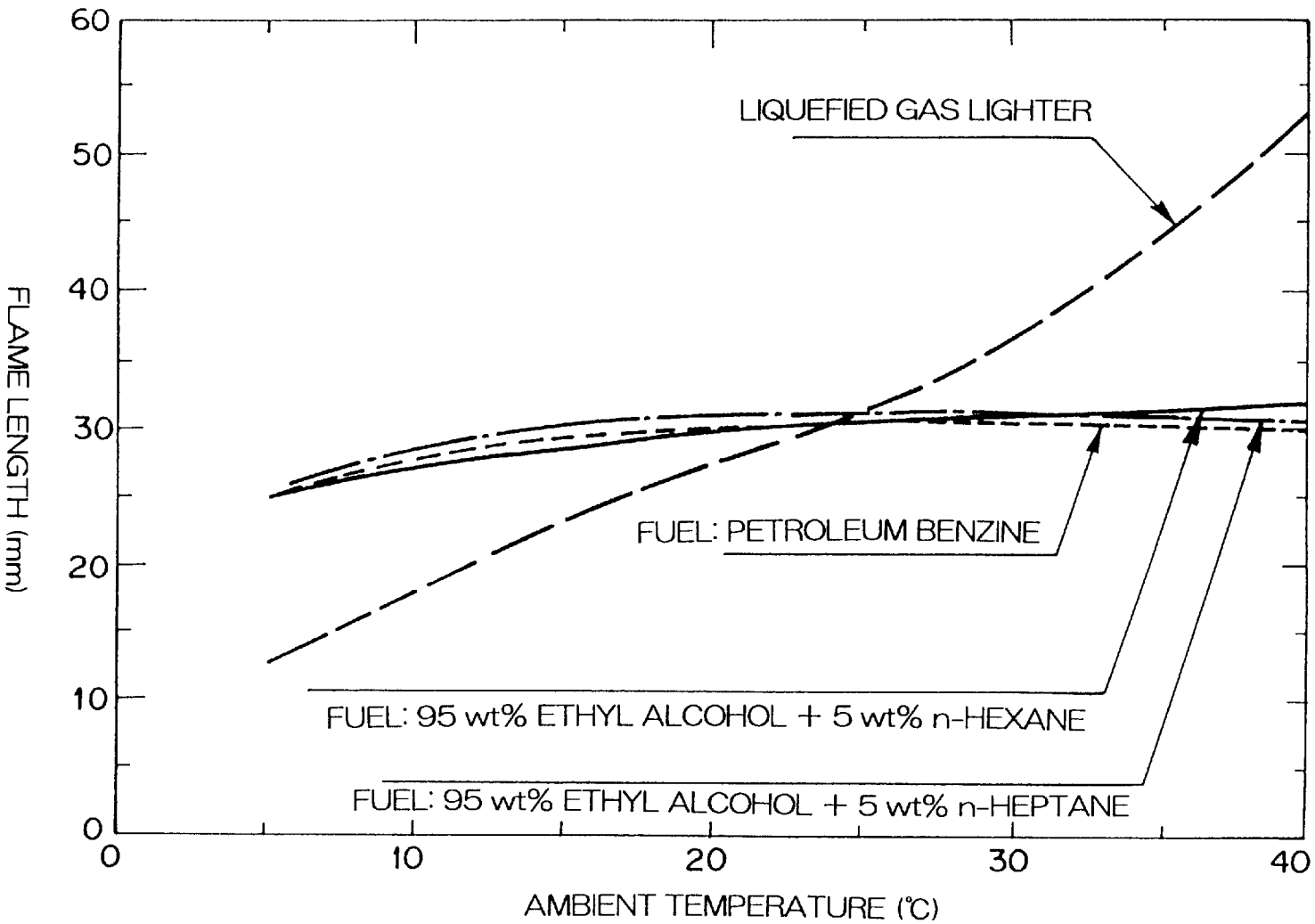
FIG. 5 is a graph showing the results of Experimental Example 4 carried out for finding the relationship between the ambient temperature and the flame length in a lighter with the first liquid fuel in accordance with the present invention, the graph also showing the results of comparative examples.

The results shown in FIG. 5 were obtained. As illustrated in FIG. 5, with the liquefied gas lighter, as the ambient temperature became high, the flame length became long. This is because, since the flame length of the liquefied gas depends upon the saturated vapor pressure of the gas, as the ambient temperature becomes high, the gas pressure becomes high and the amount of the gas jetted out increases. On the other hand, with the liquid fuels in accordance with the present invention and with the liquid fuel composed of petroleum benzine, since there was no effect of the vapor pressure of the liquid fuel, a large change in flame length did not occur at ambient temperatures falling within the range of 5° C. to 40° C.

EXPERIMENTAL EXAMPLE 5

In the experiments, a change in entire flame length with respect to a continuous combustion time was measured. Also, in a comparative example, such a change was measured by using a liquid fuel, which was composed of petroleum benzine. As the liquid fuels in accordance with the present invention, as in Experimental Example 4, the alcohol type of liquid fuel, which contained n-hexane as the flame reaction agent, and the alcohol type of liquid fuel, which contained n-heptane as the flame reaction agent, were used. The liquid fuel in the comparative example was petroleum benzine. As for each of the liquid fuels, 4 cc of the liquid fuel was injected into the lighter, and the lighter was adjusted such that the flame length might be 30 mm at an ambient temperature of 23° C. After the lighter was left to stand for some time, continuous combustion was carried out for two minutes, and a change in flame length was measured.

Figure 6:
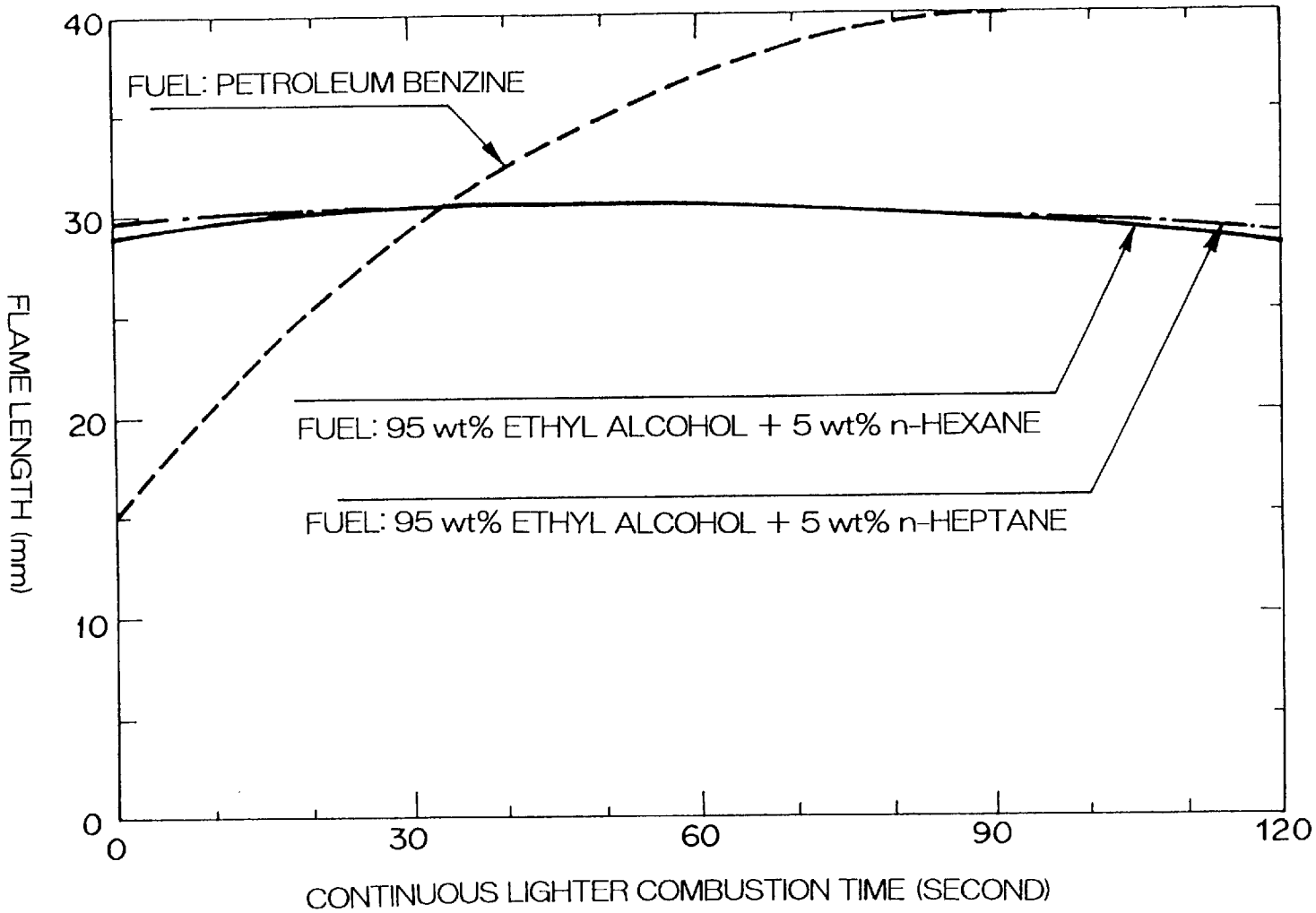
FIG. 6 is a graph showing the results of Experimental Example 5 carried out for finding the relationship between the continuous combustion time and the flame length in a lighter with the first liquid fuel in accordance with the present invention, the graph also showing the results of a comparative example.

The results shown in FIG. 6 were obtained. As illustrated in FIG. 6, with the lighter using petroleum benzine as the liquid fuel, the flame length became long with the passage of the combustion time, and reached 40 mm after approximately 90 seconds. On the other hand, with the liquid fuels in accordance with the present invention, the initial flame length of 30 m was approximately kept unchanged.

EXPERIMENTAL EXAMPLE 6

In the experiments, the natural evaporation rates of the liquid fuels in accordance with the present invention were measured in comparison with that of the liquid fuel composed of petroleum benzine. In the same manner as that described above, as for each of the two kinds of the alcohol types of liquid fuels in accordance with the present invention and the liquid fuel composed of petroleum benzine in the comparative example, 4 cc of the liquid fuel was injected into the lighter, the cap of the lighter was opened, and the lighter was left to stand for some time. In such cases, the amount of the liquid fuel evaporated with the passage of time was measured.

Figure 7:
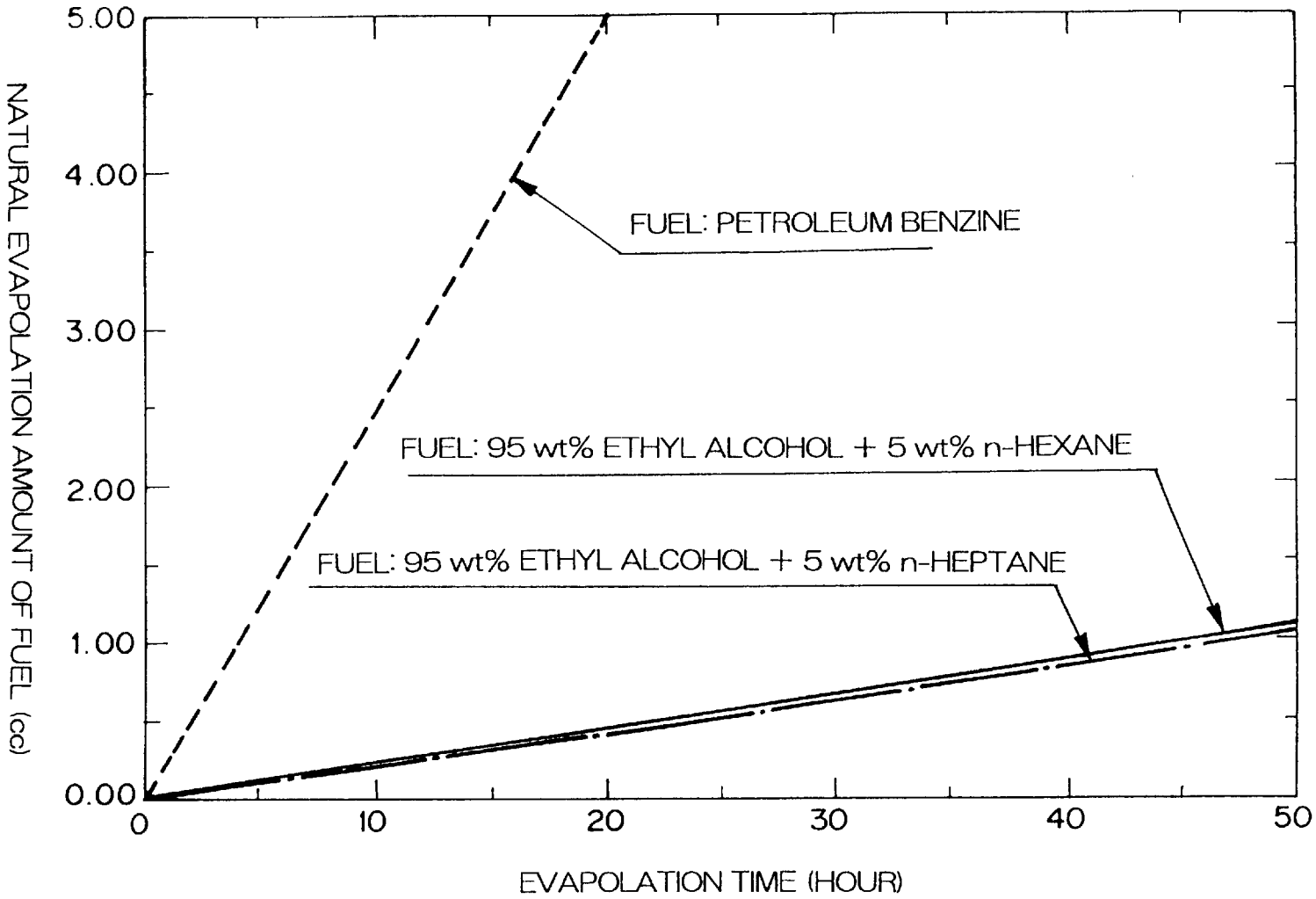
FIG. 7 is a graph showing the results of Experimental Example 6 carried out for finding the relationship between the cap opening time and the evaporation amount in a lighter with the first liquid fuel in accordance with the present invention, the graph also showing the results of a comparative example.

The results shown in FIG. 7 were obtained. As illustrated in FIG. 7, since petroleum benzine has a high volatility, with the lighter using petroleum benzine as the liquid fuel, the liquid fuel evaporated quickly. On the other hand, with the lighters using the liquid fuels in accordance with the present invention, the evaporation amount of the alcohol fuel was small, and the rate of decrease in the amount of liquid fuel was slow.

EXPERIMENTAL EXAMPLE 7

In the experiments, a change in flame length with respect to a change in ambient temperature was measured by using a second liquid fuel in accordance with the present invention. Also, in comparative examples, such a change was measured by using a liquid fuel, which was composed of ethyl alcohol, a liquid fuel, which was composed of petroleum benzine, or a liquefied gas lighter.

As the liquid fuels in accordance with the present invention, a liquid fuel composed of n-heptane, a liquid fuel composed of n-octane, and a liquid fuel composed of n-nonane were used. In the comparative examples, a liquid fuel, which was composed of ethyl alcohol, and a liquid fuel, which was composed of petroleum benzine, were used. As for each of the liquid fuels, 4 cc of the liquid fuel was injected into the lighter, and a change in flame length was measured by changing the ambient temperature to a value falling within the range of 5° C. to 40° C. Also, in a different comparative example, a commercially available liquefied gas lighter, which was filled with a liquefied gas containing i-butane as the principal fuel, was prepared, and a change in flame length was measured by changing the ambient temperature in the same manner. In every experiment, the reference flame length was adjusted such that the flame length might be 30 mm at an ambient temperature of 23° C.

Figure 8:
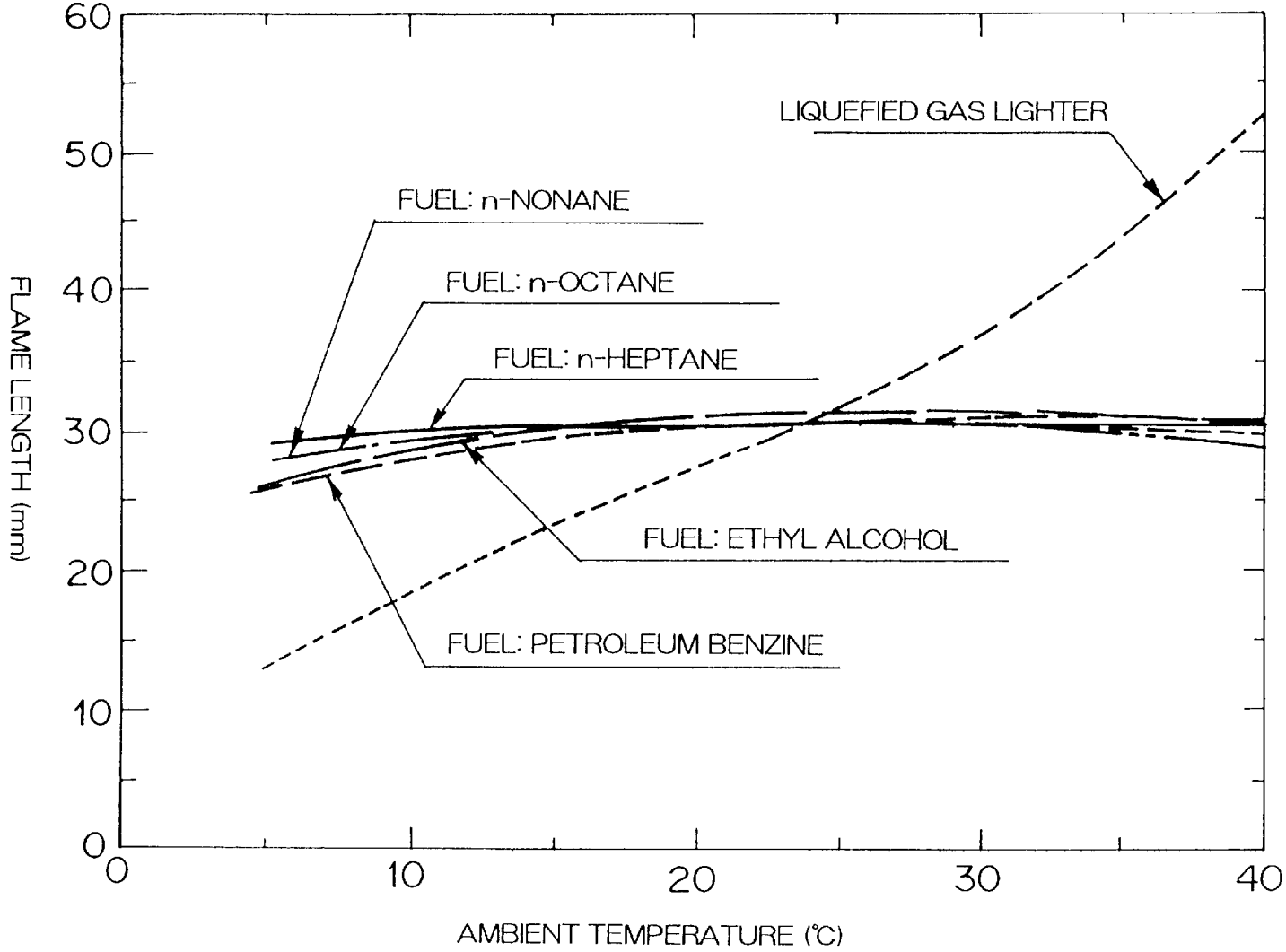
FIG. 8 is a graph showing the results of Experimental Example 7 carried out for finding the relationship between the ambient temperature and the flame length in a lighter with a second liquid fuel in accordance with the present invention, the graph also showing the results of comparative examples.

The results shown in FIG. 8 were obtained. As illustrated in FIG. 8, with the liquefied gas lighter, as the ambient temperature became high, the flame length became long. This is because, since the flame length of the liquefied gas depends upon the saturated vapor pressure of the gas, as the ambient temperature becomes high, the gas pressure becomes high and the amount of the gas jetted out increases. On the other hand, with the three kinds of liquid fuels in accordance with the present invention, with the liquid fuel composed of the alcohol, and with the liquid fuel composed of petroleum benzine, since there was no effect of the vapor pressure of the liquid fuel, a large change in flame length did not occur at ambient temperatures falling within the range of 5° C. to 40° C.

EXPERIMENTAL EXAMPLE 8

In the experiments, a change in flame length with respect to a continuous combustion time was measured. Also, in comparative examples, such a change was measured by using a liquid fuel, which was composed of ethyl alcohol, or a liquid fuel, which was composed of petroleum benzine. As the second liquid fuels in accordance with the present invention, as in Experimental Example 7, the three kinds of saturated hydrocarbon fuels were used. Specifically, the liquid fuel composed of n-heptane, the liquid fuel composed of n-octane, and the liquid fuel composed of n-nonane were used. In the comparative examples, the liquid fuel composed of ethyl alcohol and the liquid fuel composed of petroleum benzine were used. As for each of the liquid fuels, 4 cc of the liquid fuel was injected into the lighter, and the lighter was adjusted such that the flame length might be 30 mm at an ambient temperature of 23° C. After the lighter was left to stand for some time, continuous combustion was carried out for two minutes, and a change in flame length was measured.

Figure 9:
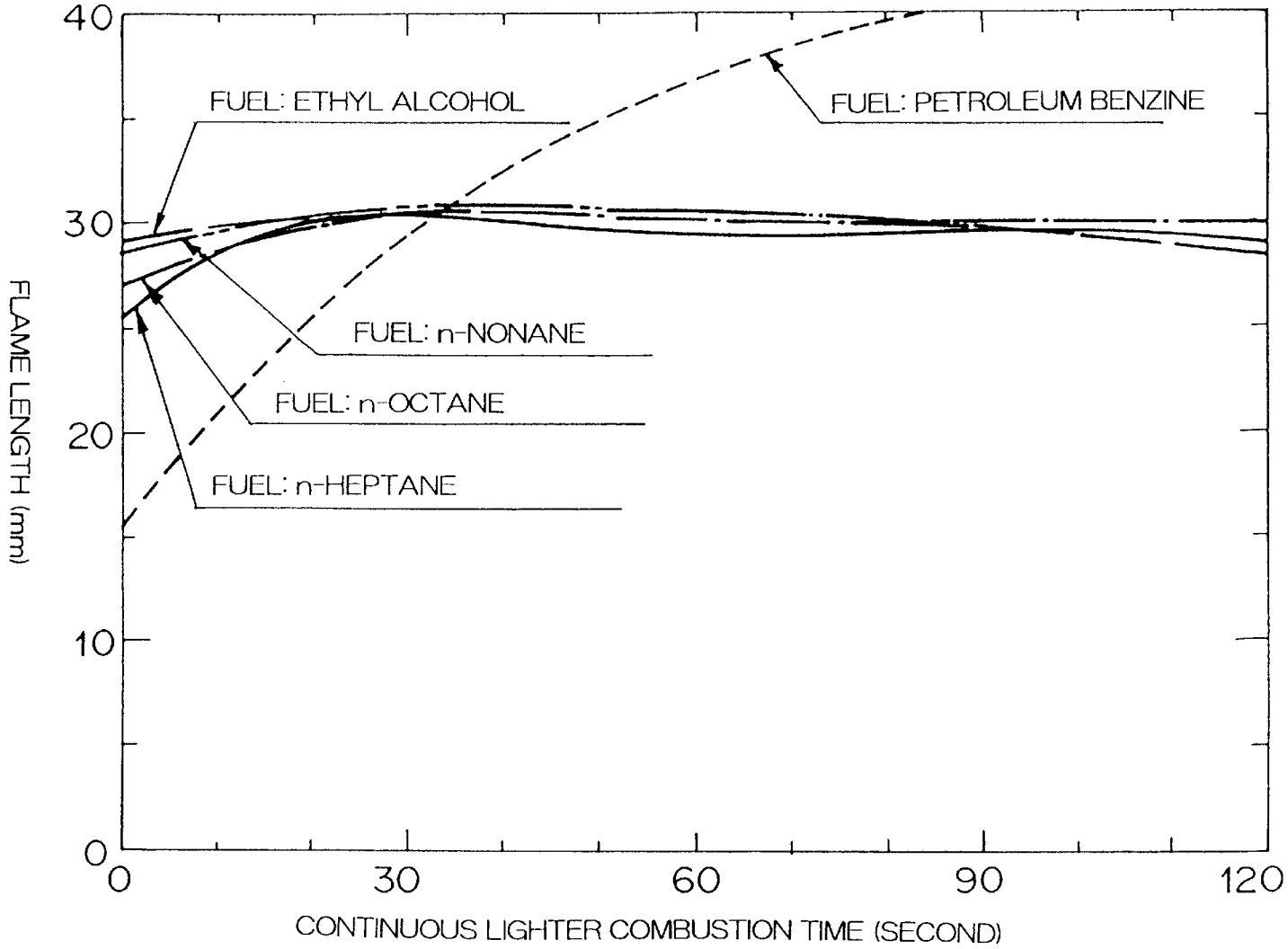
FIG. 9 is a graph showing the results of Experimental Example 8 carried out for finding the relationship between the continuous combustion time and the flame length in a lighter with the second liquid fuel in accordance with the present invention, the graph also showing the results of a comparative example.

The results shown in FIG. 9 were obtained. As illustrated in FIG. 9, with the lighter using petroleum benzine as the liquid fuel, the flame length became long with the passage of the combustion time, and reached 40 mm after approximately 90 seconds. On the other hand, with the liquid fuels in accordance with the present invention and with the ethyl alcohol fuel, the initial flame length of 30 m was approximately kept unchanged.

EXPERIMENTAL EXAMPLE 9

The experiments were carried out in order to find the relationship between the number of times of lighter use and the flame length. As the liquid fuels in accordance with the present invention, as in Experimental Examples 7 and 8, the three kinds of saturated hydrocarbon fuels were used. Specifically, the liquid fuel composed of n-heptane, the liquid fuel composed of n-octane, and the liquid fuel composed of n-nonane were used. Also, in a comparative example, the liquid fuel composed of ethyl alcohol was used. As for each of the liquid fuels, 4 cc of the liquid fuel was injected into the lighter, and the length of the entire flame was adjusted at 30 mm. Thereafter, the liquid fuel was lighted with the lighting operation and allowed to burn for 1.5 seconds. The fire was then extinguished. The use operation was repeated, and the flame length was measured at intervals of a predetermined number of times of lighter use.

Figure 10:
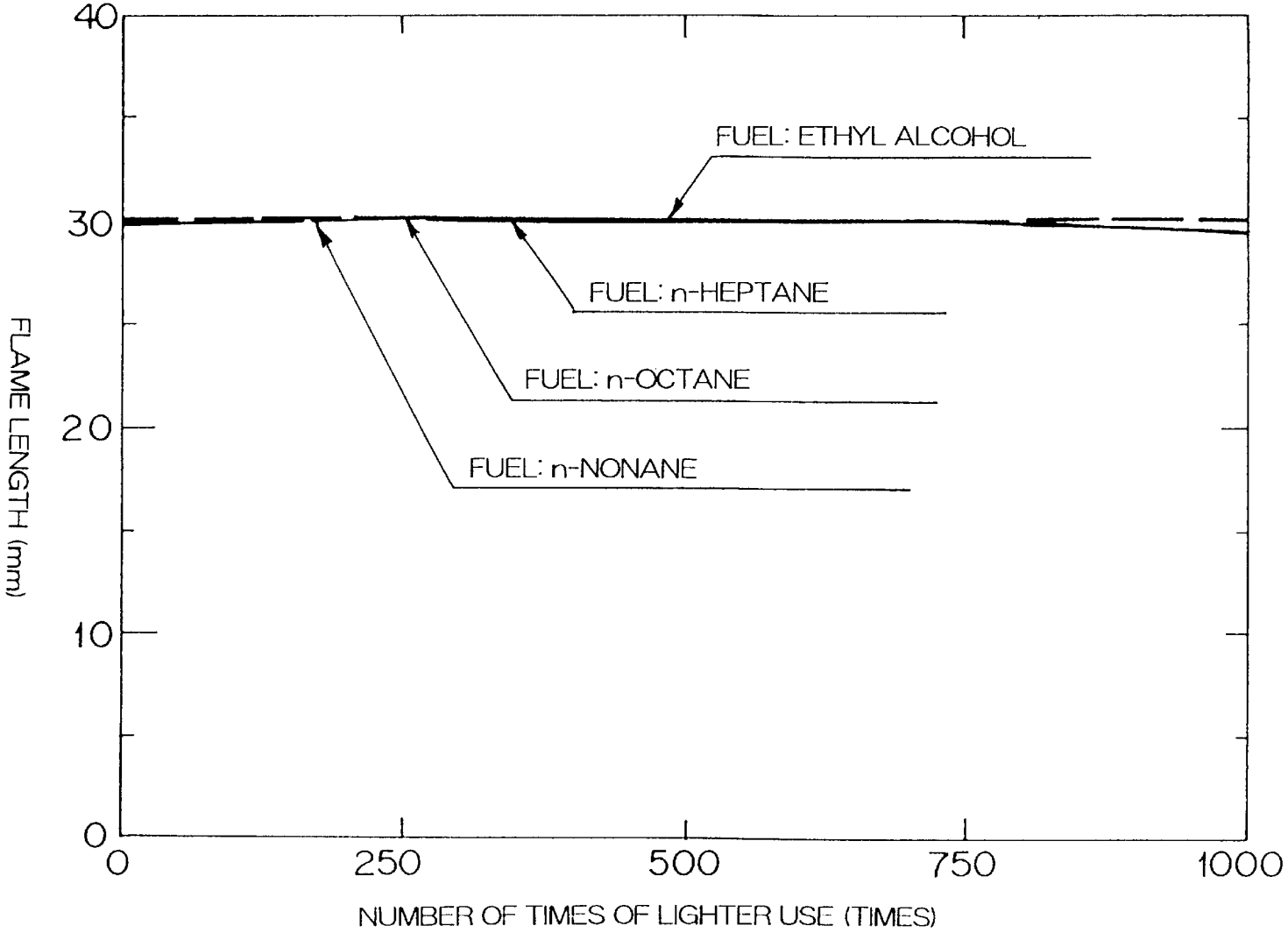
FIG. 10 is a graph showing the results of Experimental Example 9 carried out for finding the relationship between the number of times of lighter use and the flame length with the second liquid fuel in accordance with the present invention, the graph also showing the results of a comparative example.

The results shown in FIG. 10 were obtained. As illustrated in FIG. 10, with these liquid fuels, even though the number of times of lighter use became large, the flame length did not change.

What is claimed is:

1. A liquid fuel for combustion appliances, in which a combustion wick for sucking up the fuel by the utilization of capillarity is used, the liquid fuel consisting essentially of an alcohol as a principal constituent and a hydrocarbon compound, which has approximately the same boiling point as that of the principal constituent, as a flame reaction agent.

2. A liquid fuel as defined in claim 1 wherein the principal constituent is a lower monohydric alcohol selected from the group consisting of methyl alcohol, ethyl alcohol, and propyl alcohol, and the flame reaction agent is a saturated hydrocarbon, which has a boiling point close to the boiling point of the principal constituent.

3. A liquid fuel as defined in claim 1 wherein the principal constituent is ethyl alcohol, and the flame reaction agent is at least one kind of hydrocarbon selected from the group consisting of hexane and heptane.

4. A liquid fuel for combustion appliances, in which a combustion wick for sucking up the fuel by the utilization of capillarity is used, wherein the liquid fuel is composed of at least one kind of compound selected from the group consisting of heptane, octane, and nonane.

5. A combustion appliance, comprising:

i) a fuel reservoir for storing a liquid fuel, the liquid fuel containing an alcohol as a principal constituent and containing a hydrocarbon compound, which has approximately the same boiling point as that of the principal constituent, as a flame reaction agent, ii) a combustion wick, which sucks up the liquid fuel from the fuel reservoir by the utilization of capillarity and enables the liquid fuel to be burned at an end portion, and iii) a lighting mechanism, which lights the combustion wick.

6. A combustion appliance, comprising:

i) a fuel reservoir for storing a liquid fuel, which is composed of at least one kind of compound selected from the group consisting of heptane, octane, and nonane, ii) a combustion wick, which sucks up the liquid fuel from the fuel reservoir by the utilization of capillarity and enables the liquid fuel to be burned at an end portion, and iii) a lighting mechanism, which lights the combustion wick.

* * * * *